United States Patent [19]

Schulman

[11] Patent Number: 4,524,762

[45] Date of Patent: Jun. 25, 1985

[54] SEAT HAVING MOVABLE SUPPORTING SURFACES

[76] Inventor: David A. Schulman, 7701 Newton Ave. N., Brooklyn Park, Minn. 55444

[21] Appl. No.: 494,942

[22] Filed: May 16, 1983

[51] Int. Cl.[3] ..... A61H 1/00

[52] U.S. Cl. ..... 128/33; 128/64; 5/60; 297/284

[58] Field of Search ..... 128/33, 38, 57, 60, 128/61, 64, 67; 5/60–63; 297/284, 312, 453

[56] References Cited

U.S. PATENT DOCUMENTS

| | | | |
|---|---|---|---|
| 2,445,158 | 7/1948 | Sparhawk . | |
| 2,684,672 | 7/1954 | Summerville | 128/33 |
| 2,773,498 | 11/1973 | Himmelman . | |
| 2,906,259 | 9/1959 | Adair . | |
| 3,298,363 | 1/1967 | Parkin | 128/33 |
| 3,483,862 | 12/1969 | Takeuchi . | |
| 3,656,190 | 4/1972 | Regan | 5/60 |
| 3,919,730 | 11/1975 | Regan | 128/33 X |
| 3,945,063 | 3/1976 | Matsuura | 5/63 |
| 3,970,077 | 7/1976 | Dahl | 128/33 |

*Primary Examiner*—Richard J. Apley
*Assistant Examiner*—David J. Brown
*Attorney, Agent, or Firm*—James V. Harmon

[57] ABSTRACT

A seat is described which includes provision for two support surfaces comprising a matrix having openings through which a multiplicity of support plugs extend. The support plugs are raised and lowered through the openings by the provision of a fluid inflatable bag provided within the seat below a support plate to which the plugs are connected.

12 Claims, 9 Drawing Figures

SEAT HAVING MOVABLE SUPPORTING SURFACES

FIELD OF THE INVENTION

The invention relates to seating devices and more particularly to a seat having moving parts to improve blood circulation, posture and comfort.

BACKGROUND OF THE INVENTION

A number of seating devices have been previously proposed for improving comfort and blood circulation in the lower part of the body. For example, U.S. Pat. No. 2,684,672 describes a body support device in the form of a seat that can be used by pilots. It includes a flexible cushion divided into airtight chambers which rise or fall when air is fed under the influence of a control apparatus to alternate sets of chambers. The inflatable cushion is, however, subject to being punctured but more importantly it has a tendency to trap body moisture between itself and the skin of the person using it because it must be air impermeable. By contrast, U.S. Pat. Nos. 3,970,077, 2,445,158 and 2,773,498 show various forms of beds or chairs with movable support surfaces that are raised and lowered during operation by means of cams mounted on rotating shafts which during operation contact suitable cam followers to lift one, two or three sets of supporting blocks into contact with the skin to thereby provide support for the body at different locations depending upon whether the blocks are raised or lowered. These devices have significant shortcomings. First, the motor used for raising or lowering the suppporting blocks must, of necessity, be mounted on the seat itself making the seat heavy and bulky. In addition, the cam mechanism adds further to its cost and can become worn or out of adjustment. In addition, the seat can become noisy to operate if the parts begin to wear where the cam followers rub against the cam surfaces. The result is an expensive, cumbersome and complicated mechanism which is subject to wear and there is a considerable opportunity for the device to malfunction.

The present seat has several benefits. First, it is very comfortable for such as heavy equipment operators and airplane pilots who are required to remain seated for long periods of time. Another benefit of the invention is in the promotion of better blood circulation. This helps to alleviate the formation of what are commonly referred to as pressure sores or decubitus ulcers. Although decubitus ulcer development can be resisted by maintaining good nutrition and hygiene, it still occurs, for example, among wheelchair-bound persons who experience prolonged local body pressure against the seat in excess of 25 mm Hg(which is equivalent to 0.5 lb. per square inch or 13.4 inches of water). This static pressure is generally considered enough to compress the capillaries and shut off circulation to the skin and underlying tissues. Tissue death then proceeds unless the body is moved to bring other tissues into a weight supporting role and the closed capillaries are allowed to reopen and resupply the denied tissues. Normally, body movement enables muscles and tissues to avoid deterioration resulting from immobility, but persons with spinal cord injury or muscular debility may not be able to reposition their weight or even sense the discomfort of their support areas, which increases the risk that they will develop pressure sores. Moreover, the maceration damage to the skin of incontinent patient's and the maintenance of good skin hygiene is affected by the ability of the patient's supporting seat or couch to carry away water from the skin and allow air circulation over the skin. There is often not enough time for unhurried and careful massage of delicate tissues by nurses whose work schedules are full. It would be beneficial if the patient's supporting seat, whether or not a part of a wheelchair, could provide an action adapted to shift support points from time to time. Nurses must also have good control over a patient in order not to bruise or shear damage the patient's skin or strain themselves. In general, nurses favor systems which do not complicate or slow their work. The patient care institution shares these preferences for a support seat that increases patient benefits and does these things reliably and with cost effectiveness.

Alternating pressure pad (A.P.P.) systems in common use for the treatment of patients suffering from pressure sores consist of a series of intermingled, variously shaped, inflatable tubes upon which the patient lies or sits. During use, alternate sets of tubes are inflated and deflated repeatedly thereby shifting the support points. These devices are helpful but, like the pilot's seat described above, they are subject to puncture and tend to trap moisture between the patient's skin and the air impermeable air inflated tubes.

When used as seat cushions, inflatable tubes constitute an unstable shifting support which complicates posture control. Additionally, because of their power requirements, A.P.P. wheelchair cushions have not been marketed as battery powered devices, but have been powered from 117 volt Ac wall outlets.

The general objective of the present invention is to overcome these and other deficiencies of the prior art and to provide an improved seat having a multiplicity of supporting surfaces adapted to alternately and selectively support different areas of the body to thereby shift the points of support from time to time while eliminating mechanical mechanisms employed for moving the support surfaces into and out of engagement with the body of the user. These and other more detailed and specific objects will be apparent by reference to the following specification and figures.

SUMMARY OF THE INVENTION

Briefly, the present invention provides an improved seat having a combination of locally intermingled stationary and movable supporting surfaces which together constitute a contoured seat surface that promotes comfort and improved blood circulation. The seat is used as the seat of a chair with or without a back and includes a stationary first supporting surface or matrix having a multiplicity of openings within it through which support plugs project. The support plugs are all connected together. The upper surfaces of adjacent plugs are elements of the seat contour so that the plugs considered together provided a contoured, interrupted surface, seat support when raised. When the movable seat surface is lowered, the person's body weight is supported upon the stationary matrix member that extends between the spaced-apart plug members. The plugs move collectively as a plug assembly comprising a plurality of plugs supported together upon a plug plate. During operation, the plug plate is raised and lowered by the provision of a fluid inflatable flexible bladder operatively associated with the plug assembly and preferably located beneath the plug plate and above a base member or tray. The bladder is connected to a suitable source of inflation gas or liquid adapted to raise the plugs through the openings in the matrix to an upper extended supporting position. When the plate and the plugs are lowered by partially or completely emptying the bladder, the tops of the plugs fall to an elevation below the elevation of the matrix in which the plugs are located thereby shifting the weight of the user to the parts of the skin between the plugs and in contact with the matrix. The seat is normally covered by a thin cloth cover so that the plugs and matrix are not visible.

DESCRIPTION OF THE PREFERRED EMBODIMENT

In overcoming the deficiencies described in connection with the prior art and to accomplish the foregoing and related ends, the invention is described by way of example, the following description setting forth in detail certain illustrative embodiments of the invention that indicate, however, only a few of the variations that can be made in the invention within the scope of the appended claims.

Figure 1:
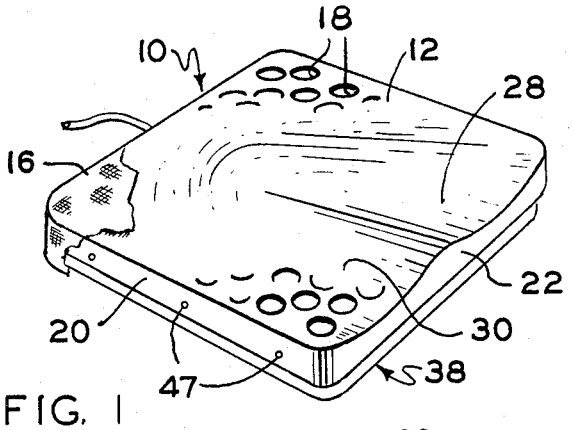
FIG. 1 is a perspective view of the invention.
Figure 2:
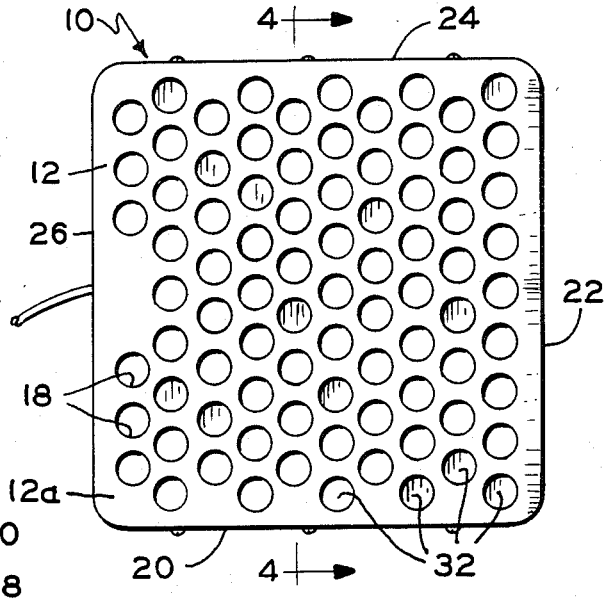
FIG. 2 is a plan view on a larger scale.

In accordance with the present invention, a unique seat is provided for promoting blood circulation and comfort to the user by supporting different portions of the body of the user at different times. The seat is indicated generally by the numeral 10 and in this instance is generally rectangular as seen from above but may have other shapes such as circular or oval as the application requires. The top of the seat comprises a matrix 12 formed, for example, from plastic or metal plate or other sheet material that may be on the order of about $\frac{1}{8}$" in thickness. Beneath the matrix 12 is a plug plate 14 having laterally extending side edges 14*a* that just fit within the confines of the matrix 12. During use, the seat 10 is enclosed within a cloth cover of any suitable kind such as a low friction stretch cover formed, for example, from a fabric such as Lycra. The cover 16 may be suitably held in place in any convenient way as, for example, by means of Velcro strips (not shown). In the drawings, the cover 16 has been removed except for the portion thereof shown in FIG. 1 so that the working parts of the apparatus can be seen and for clarity of illustration. Within the upper surface 12*a* of the matrix 12 is an array of openings 18 which in this instance are arranged in columns and rows extending throughout the width and breadth of the upper surface 12*a* of the matrix 12. Those openings contain movable plugs which will be described below. The matrix 18 includes four side walls, 20, 22, 24 and 26, extending vertically and at right angles to one another to define the sides of the matrix. The upper surface 12*a* of the matrix 12 is provided with a dished contour to provide comfortable support and includes a pair of forwardly extending leg depressions 28 and 30 (FIG. 1).

Figure 4:
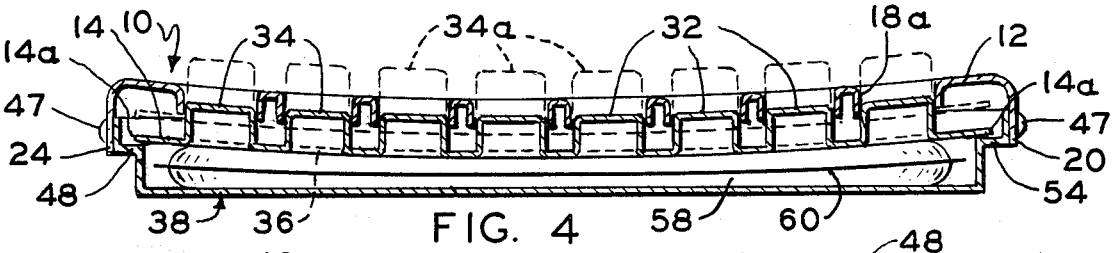
FIG. 4 is a transverse sectional view taken on line 4—4 of FIG. 2 on an enlarged scale.

Slidably mounted for movement along a vertical axis within each opening 18 is a vertically extending plug 32. Each plug has an upward surface or top 34 which, when considered together, are also contoured with the same curvature as the upper surface 12*a* of the matrix (FIG. 4). The plugs 32 are all connected together to move the unit and, in this instance, all are a part of the plug plate 14. When moved upwardly as shown in dotted lines in FIG. 4, their upper surfaces 34 cooperate to form a secondary support surface indicated at 34*a*. When lowered to the solid line position of FIG. 4, the body is supported by the portions of the matrix between the openings 18. The plugs 32 have cylindrical side walls 32*a* which fit slidably within the cylindrical downwardly extending walls 18*a* (FIG. 4) of the openings 18 to permit a smooth sliding action, the walls 18*a* serving collectively as guides for the plugs. As can be seen in FIG. 4, plugs 32 are connected to the plug plate 14 at their lower edges 36. In this case, the plugs 32 comprise upright downwardly opening and upwardly projecting deflected portions of the plug plate itself. Plugs 32 can be solid if desired but are preferably hollow as shown to provide a strong but light structure. The tops 34 of the plugs 32 are preferably flat and contoured when considered as a whole to form a surface that fits the body. The plugs can, of course, have other cross-sectional configurations such as rectangular, hexagonal, oval or oblong. Other shapes will be apparent. The plugs may be about 1 5/16" in diameter. It is preferred that the upper surface 12*a* of the part of the matrix 12 between the plugs have approximately the same area as the combined area of the upper surfaces of the plugs. In this way, the person's body is supported by supporting surfaces of equal size whether the plugs are in their elevated position or in their lower retracted position.

The lower portion of the seat comprises a base or tray 38 of generally dish-shaped configuration and includes four vertically disposed peripherally distributed upwardly extending side walls 40, 42, 44 and 46.

The seat can be formed from a variety of materials such as high density polyethylene and the normal lubricity of the surfaces will promote smooth operation and reduce friction. The matrix 12 and the base 38 are secured rigidly together, for example by screws 47, and the upward travel of the plate 14 is limited by the contact with the matrix 12.

Below the upper edges of the side walls are provided centrally extending shoulders 48, 50, 52 and 54 having flat upper surfaces positioned below the upper edge of the side wall of the base and serve as supports for the plug plate 14. Thus, the edges of the plug plate 14 rest on the shoulders 48–54 when in their lowermost position preventing the plate from falling to the bottom of the seat and providing a space between the plug plate and the base 38 to accommodate a fluid inflatable bag or bladder 58. The internal shoulders 48–54 are located just above a peripheral undercut or recess around the outside edge of the bottom of the tray. This recess can be highly useful in some situations to accommodate side rails (not shown) that are a part of a wheelchair. In this way the seat bottom can be nested down between the rails lowering the entire seat a controlled amount for special patient needs. In the side wall 42 of the base 38 is a filling tube recess 56 to accommodate a filling tube to be described below.

Figure 5:
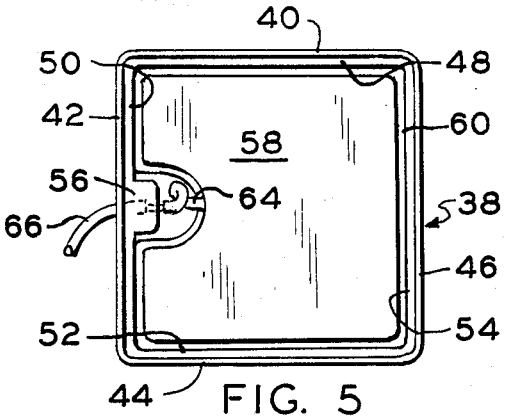
FIG. 5 is a plan view of the supporting base or tray 38 defining the lower aspect of the seat with a fluid inflatable bladder in place within the tray.
Figure 6:
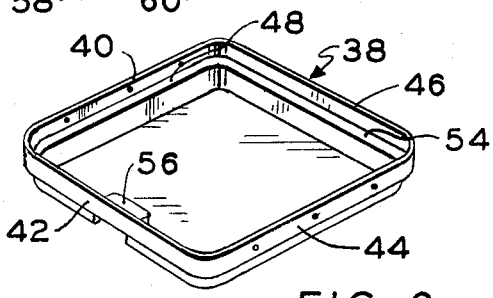
FIG. 6 is a perspective view of the base or tray.

The fluid inflatable bag or bladder 58 which can be best seen in FIGS. 4 and 5 is generally rectangular in configuration as seen in plan view. The bladder 58 is formed from two pieces of flat flexible fluid impervious material that are sealed together along their edges at 60 (FIG. 5). An indentation is provided in one edge to accommodate the filling tube recess 56. A filling spout 64 is connected to the inflatable bag 58 and also to a threaded pipe 65 which is in turn connected to an air tube 66. The threaded pipe 65 is screw threaded into a nut 67 mounted within the vertical wall section of the recess 56.

Figure 7:
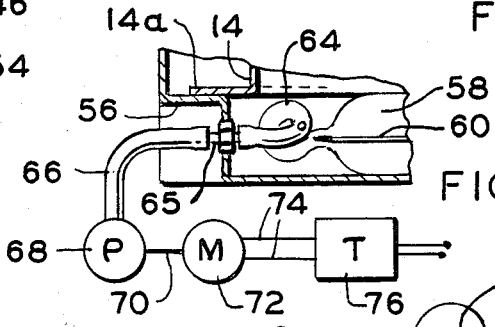
FIG. 7 is a partial diagrammatic cross-sectional view of the portion of the seat where the filling tube 66 enters.
Figure 9:
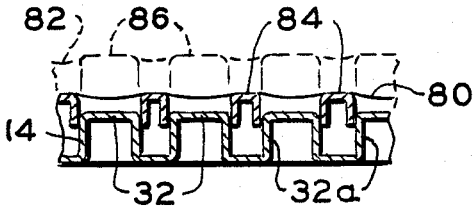
FIG. 8 is a partial side elevational view of the filling tubes 66 and 64 and FIG. 9 is a partial transverse sectional view similar to FIG. 4 showing the plugs in lowered or elevated position with the body of the user in contact with the seat in two alternative positions.
Figure 8:
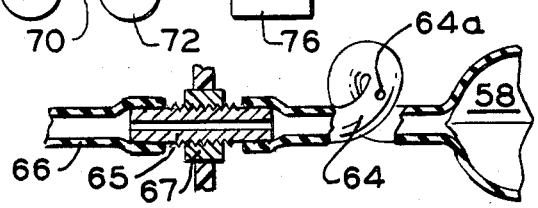

As shown in FIGS. 7 and 8, the fill tube 64 is provided with a bleed port **64*a* having a predetermined diameter, e.g., 1/32" in a typical application. The fill tube 66 is connected to a pump 68 which is in turn coupled via drive shaft 70 to a drive motor 72 that is itself wired by conductors 74 to a timer 76 which is supplied with standard house current or powered by batteries as desired (FIG. 7). In FIG. 9, the plate 14 is shown in the lower position in solid lines and in an elevated position in dotted lines. It will be seen that the body of the person using the seat is supported by the portions 84 of the matrix extending between the plugs 32 which they are in their lower retracted position. However, when the plugs 32 are in the raised dotted line position, the body is supported by the collective ends of the plugs acting together at support points indicated at 86 which correspond with the ends of the plugs. While the dimensions of the unit can be varied widely, in a typical application the retracted plugs are about $\frac{1}{4}$" below the tops of the openings 18. When raised, they extend about $\frac{1}{2}$" above the top of the matrix 12**.

From the above description, it can be seen that the seat in accordance with the invention supports the user comfortably and with the cover 16 in place, presents an attractive appearance. The contoured surface of the seat is divided into a contoured stationary supporting surface defined by the matrix and by the movable contoured supporting surface defined by the upper ends of the plugs 32. When the bag 58 inside the seat is inflated, the plugs which together act as a movable surface slowly rise, supporting the user's weight. When the bag 58 is deflated, the movable support defined by the plugs 32 slowly descends below the stationary surface 12 so that the weight of the user is smoothly transferred to a new skin area, viz. that which rests on the stationary support surface 12 of the seat 10. It is preferred in most applications that the occupant be supported about half the time by the movable support surface and half the time by the stationary support surface comprising the matrix 12. It should be noted that the escaping air that is released from the opening **64*a* and the fill tube 64 is vented up through the seat surfaces to help keep the occupant cool and to remove moisture that might otherwise become trapped adjacent the skin. The timer T is typically set to operate for a cycle of five minutes with the pump 68 operating for approximately the first 35–40 seconds. The pump is then turned off for a period of 4.5 minutes. As the air leaks out through the control opening 64*a*, the weight of the user causes the plugs to gradually fall so that after about $2\frac{1}{2}$ minutes the plugs drop below the surface of the matrix 12** thereby providing a gradual transfer of weight from the plugs to the matrix. While the plugs have been shown as movable and the matrix stationary, the opposite arrangement could be used if desired.

From the foregoing description of the operation, it can be seen that the pump runs only about 10–15% of the time on a five-minute cycle and, accordingly, very little power is required. It can also be seen that the motion of the plugs is very smooth and gradual so that the action is almost imperceptible to the user. This action is highly beneficial since it is important not to shock or stress the skin suddenly or distract the user. If the cycle is to be shortened, the opening **64*a* is made larger and if the cycle is to be lengthened, the opening 64*a*** is made smaller.

In most applications, a small capacity diaphragm pump developing, say, 3.5 psi pressure is satisfactory. The maximum volume of air produced by such a pump is about 500 cu. in. per minute. It is economical, inexpensive to operate and safe. Such a pump, operated by a small motor connected to a battery, can lift a patient weighing more than 400 pounds. The motor 72 can be of about 6 watts maximum capacity. With a 10% duty cycle very little power is used so that battery life is extremely good. Such a unit will consume about 1.0 amp-hrs. in ten hours causing an inconsequential drain on the battery. In the alternative, the timer T can be plugged into a wall socket when there is no battery on the wheelchair. It can also be operated in automobiles from a cigarette lighter or power pack.

The lowermost position of the plugs 14 is accurately controlled by the peripheral edge portions **14*a* of the plug plate 14 which rests on the shoulders or stops 48–54. This leaves adequate space for the inflatable air bag 58 and prevents the plug plate 14** from damaging it. The total travel of the plug plate is about $\frac{3}{4}$".

Many variations can be made in the provisions for raising and lowering the plug plate. The concept of providing controlled leakage through the orifice **64*a*** is effective and yet requires no extra parts. Moreover, operation is essentially automatic as soon as the pump stops.

The seat in accordance with the present invention thus provides a safe, dynamic seat for use in a variety of applications including such as a wheelchair seat for hospital patients. It presents no electrical shock hazard since it is well adapted for use over long periods of time with battery power. It will not balloon or bottom out as an air mattress does. Moreover, the seat always maintains the contour of the user's body.

While it has been shown for use as a seat, it can also be used with a different contour for supporting other portions of the body such as the back or feet. In the latter application, the seat is contoured to fit the feet and the lower portion of the legs. It can also be seen that the body 80 (FIG. 9) does not touch the tops of the plugs 32 when in their fully retracted position and that when the downward pressure of the body is no longer exerted against the plugs 32, the bladder 58 will no longer deflate. In other words, the body forces the plugs down until it can no longer reach the plugs. In this way, a small amount of air is usually retained in the bladder after the deflation step thereby reducing the filling time and promoting more economical operation.

Figure 3:
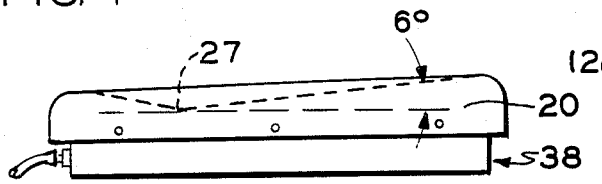
FIG. 3 is a side elevational view of the seat as seen from its right side.

The lowermost portion 27 of the seat as shown in FIG. 3 will support the ischial tuberoscities. For most applications, the leg depressions 28 and 30 are inclined upwardly from the low point 27 at an angle of about 6° to the horizontal as shown in FIG. 3. While the dimensions may vary widely, the front wall 22 may be made about 3" high and the rear wall 26 about 2½" high. The invention permits convenient sliding transfer of the patient onto and off of the seat. Moreover, there are no electrical seat components which could produce a shock hazard.

The fluid inflatable bladder used in the present invention is in a protected location where it cannot be punctured. The fluid can be a liquid or gas but air is preferred. Unlike air inflated cushions used alone, the present invention promotes the free circulation of air beneath the patient. After the air escapes from the bladder 58, it flows upwardly around the plugs to further facilitate positive circulation. In this way, when the patient is resting on the top of the plugs 32, the air flows upwardly against the portion of the skin between the plugs and when the user is resting on the matrix 12, then the air flowing upwardly contacts the skin in the area above the plugs. The seat can be easily cleaned by immersing it in water. With the bladder 58 removed, the entire lower tray portion 38 can be quickly cleaned with ordinary cleaning solutions whereas the screws, cams and cam followers used in the prior devices are prone to damage by dust, grit and water as well as being more expensive. It can also be seen that, whereas the use of lifting devices in the form of screws or cams require cross beams and the like to distribute stresses, the air bag 58 of the present invention lifts all parts of the plug plate assembly 14 equally. Thus, the air bag 58 serves as a means for evenly and uniformly distributing the upward pressure against the plug plate without the use of mechanical elements.

Many variations and modifications of the invention will be apparent to those skilled in the art within the scope of the appended claims once the principles of the invention are understood.

What is claimed is:

1. A seat for promoting improved blood circulation, posture and comfort comprising a hollow seat body including a supporting matrix with an upwardly disposed first support surface for supporting the human body and having a plurality of openings therein, a second supporting means defined by an array of connected plugs movably mounted in the openings and adapted to slide up and down as a unit through the openings, said plugs having top surfaces comprising a second support surface adapted to support a surface of the body when elevated to an extended position above the first support surface and being adapted to permit the body of the user to rest upon the matrix when lowered to a retracted position with their top surfaces below said first surface, a fluid inflatable flexible bag mounted within the seat and connected to the plugs in motion transmitting operative association therewith to move the connected plugs as a unit when inflated to one of said positions and allowing the plugs to move together as a unit to the other of said positions when deflated.

2. The apparatus of claim 1 wherein a source of fluid under pressure is connected to the inflatable bag and timing means is connected to the fluid under pressure to allow the bag to be repeatedly inflated for a selected period of time and to be repeatedly deflated for a selected period of time.

3. The apparatus of claim 2 wherein an air tube is connected to the flexible bag, an air compressor is connected to the air tube, a motive power means is connected to the compressor to operate the compressor and a timer is connected to said motive power means to repeatedly actuate the motive power means for selected on and off periods of operation, and a means is provided for allowing air to escape from the bladder.

4. The apparatus of claim 1 wherein said matrix is formed from sheet material with said openings being distributed across the width and breadth thereof, a seat bottom is rigidly connected to the matrix, said seat bottom comprises a tray connected rigidly to the matrix and positioned below it, said second supporting means further comprising a plug plate on which said plugs are mounted which is movable within the seat between said first support surface and said tray, said plugs are rigidly located on the plug plate and extend upwardly therefrom through said openings and said inflatable bag comprises an air inflatable bladder positioned below the plug plate and between the plug plate and the tray and extending substantially throughout the width and breadth of the tray whereby the inflation of the bladder exerts an upward force on all parts of the plug plate to thereby elevate the plug plate and all of the plugs by substantially the same amount as the air bag is inflated.

5. The apparatus of claim 4 wherein a fill tube is connected to the air bag, an air escape orifice of a controlled diameter communicates with the air bag to permit escape of air therefrom at a controlled rate, a compressor is connected to the fill tube, motive power means is connected to the compressor and timing means is connected to the power means to turn the motive power means on and off for selected periods of time whereby the air bag is allowed to inflate at a selected rate to thereby raise the body of the user above the matrix whereupon the timer is adapted to interrupt the operation of the compressor and the continued escape of fluid through the orifice allows the air bag to gradually deflate thereby allowing the plugs and plug plate to gradually descend until the user's body is again supported upon the matrix between the plugs.

6. The apparatus of claim 1 wherein the matrix comprises a seat element formed from sheet material of predetermined thickness including an upper wall extending generally horizontally and forming said first support surface and having a peripheral edge and further having side walls connected to said edge and extending downwardly from the edge of the top wall.

7. The apparatus of claim 6 wherein said seat includes a base comprising a tray formed from sheet material having flat lower section and upwardly extending side walls corresponding in shape to the side walls of the matrix and adapted to slide in telescopic relationship with the side walls of the matrix, fasteners connect the side walls of the matrix to the side walls of the base to thereby define a hollow compartment for enclosing the fluid inflatable bag below the plugs whereby the inflation thereof is adapted to produce pressure on the plugs in a direction away from the tray to thereby force the plugs upwardly through the openings in the matrix.

8. The apparatus of claim 7 wherein the tray is provided with shoulders that serve as stops for limiting the downward movement of the plugs when the fluid inflatable bag is deflated.

9. The apparatus of claim 1 wherein the plugs comprise a portion of a plug plate, each said plug comprising a vertical, upwardly extending downwardly opening hollow extension of the plug plate, said plugs being spaced apart laterally from one another and being distributed as an array across the width and breadth of the plug plate.

10. The apparatus of claim 9 wherein the vertically disposed wall extends downwardly from the edge of each opening 18 in the matrix and surrounds each plug to serve collectively as guides for the plugs.

11. The seat of claim 1 wherein the seat has a bottom tray member with an external peripherally extending recess therein to allow the seat to be nested into a chair thereby reducing the height of the seat.

12. The apparatus of claim 1 wherein a flexible layer of supple material is located above and extends across both said supporting matrix and said second supporting means and rests thereupon covering said matrix and said second supporting means.

* * * * *